United States Patent [19]

Sartor

[11] Patent Number: 5,054,214

[45] Date of Patent: Oct. 8, 1991

[54] SHELL STRUCTURE FOR SKI BOOTS

[75] Inventor: Mariano Sartor, Montebelluna, Italy

[73] Assignee: Nordica S.p.A., Montebelluna, Italy

[21] Appl. No.: 381,884

[22] Filed: Jul. 19, 1989

[30] Foreign Application Priority Data

Aug. 2, 1988 [IT] Italy ..... 82575 A/88

[51] Int. Cl.[5] ..... A43B 5/004

[52] U.S. Cl. ..... 36/119; 36/117

[58] Field of Search ..... 36/117, 118, 119, 120, 36/121, 50

[56] References Cited

U.S. PATENT DOCUMENTS

| | | | |
|---|---|---|---|
| 3,668,791 | 6/1972 | Salzman | 36/50 |
| 4,078,322 | 3/1978 | Dalebout | 36/121 |
| 4,258,481 | 3/1981 | Lamb | 36/120 |
| 4,841,650 | 6/1989 | Dodge | 36/120 X |

FOREIGN PATENT DOCUMENTS

| | | | |
|---|---|---|---|
| 2404233 | 4/1975 | Fed. Rep. of Germany | 36/120 |
| 3427612 | 2/1985 | Fed. Rep. of Germany | 36/117 |
| 2266468 | 12/1975 | France | 36/117 |

*Primary Examiner*—Paul T. Sewell
*Assistant Examiner*—Ted Kavanaugh
*Attorney, Agent, or Firm*—Guido Modiano; Albert Josif

[57] ABSTRACT

The present invention relates to a shell structure particularly usable in front-entry ski boots. The structure has at least one transverse slot which is provided at the metatarsal region and can be concealed by means of at least one band-like element. The band-like element furthermore supports means for closing itself onto the shell. The slot furthermore affects at least the outer lateral region of the shell so as to allow, once the closure means have been activated, the foot to be optimally fastened inside the shell, the securing action affecting in particular the inner lateral region of the plantar arch.

3 Claims, 2 Drawing Sheets

SHELL STRUCTURE FOR SKI BOOTS

BACKGROUND OF THE INVENTION

The present invention relates to a shell structure for ski boots.

The problem of achieving an optimum securing of the foot inside the boot, while simultaneously maintaining an optimum quality standard as regards the skier's comfort, is currently strongly felt in the field.

Many devices and solutions are in fact currently known which are intended to obtain a good securing of the foot and to maintain an optimum condition of comfort thereof.

For this purpose, German patent, No. 2031751 filed on 26 June 1970, discloses a shell structure in which the region arranged at the upper portion of the metatarsal region and on the foot instep is open and can be closed by means of an adapted flap which has levers for securing it to the shell.

Said shell furthermore has, at the upper malleolar region, adapted notches to allow a deformation of the upper quarter with respect to the shell.

This known kind of boot, however, also has disadvantages: the foot is in fact secured by exerting a pressure which is approximately perpendicular to the metatarsal region of the foot, and this is not anatomically correct, since the force exerted to achieve said securing is localized in small areas; this undoubtedly creates discomfort and irritation on the metatarsal region.

U.S. Pat. No. 4,078,322 filed on 4, Aug. 1976, discloses a boot which has a longitudinal elongated slot covered by means of a transverse band-like element.

In this case, too, it can be seen that the foot securing action occurs along a direction which is approximately perpendicular to the metatarsal region, the lateral portions of the shell adjacent to the longitudinal elongated slot being rigid.

The same Applicant also filed on 13 Jan. 1986 an Italian application, no. 19063 A/86, disclosing a front-entry ski boot in which the foot securing device comprises a band-like element which is fixed at one end to the inner lower region of the shell in the region of the foot's plantar arch and extends transversely to the foot substantially at the foot's instep region.

However said device, too, has disadvantages: empty regions between the foot and the shell are created, reducing sensitivity on the skis; the foot, though embraced, can furthermore oscillate inside the boot.

SUMMARY OF THE INVENTION

The aim of the present invention is therefore to eliminate the disadvantages described above in known types by providing a shell-structure which achieves the optimum securing of the foot inside a front-entry boot, allowing at the same time to provide an optimum fit for the skier.

Within the scope of the above described aim, an important object is to provide a shell-structure which facilitates the insertion of the foot in the boot.

Another object of the present invention is to provide a ski boot which is reliable and safe in use.

This aim, these objects and others which will become apparent hereinafter are achieved by a shell structure for ski boots, characterized in that it comprises at least one transverse slot, provided at the foot's metatarsal region and at least partially concealed by means of a band-like element which supports means for closing on said shell, said slot affecting at least the inner lateral region of said shell.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENT

Figure 1:
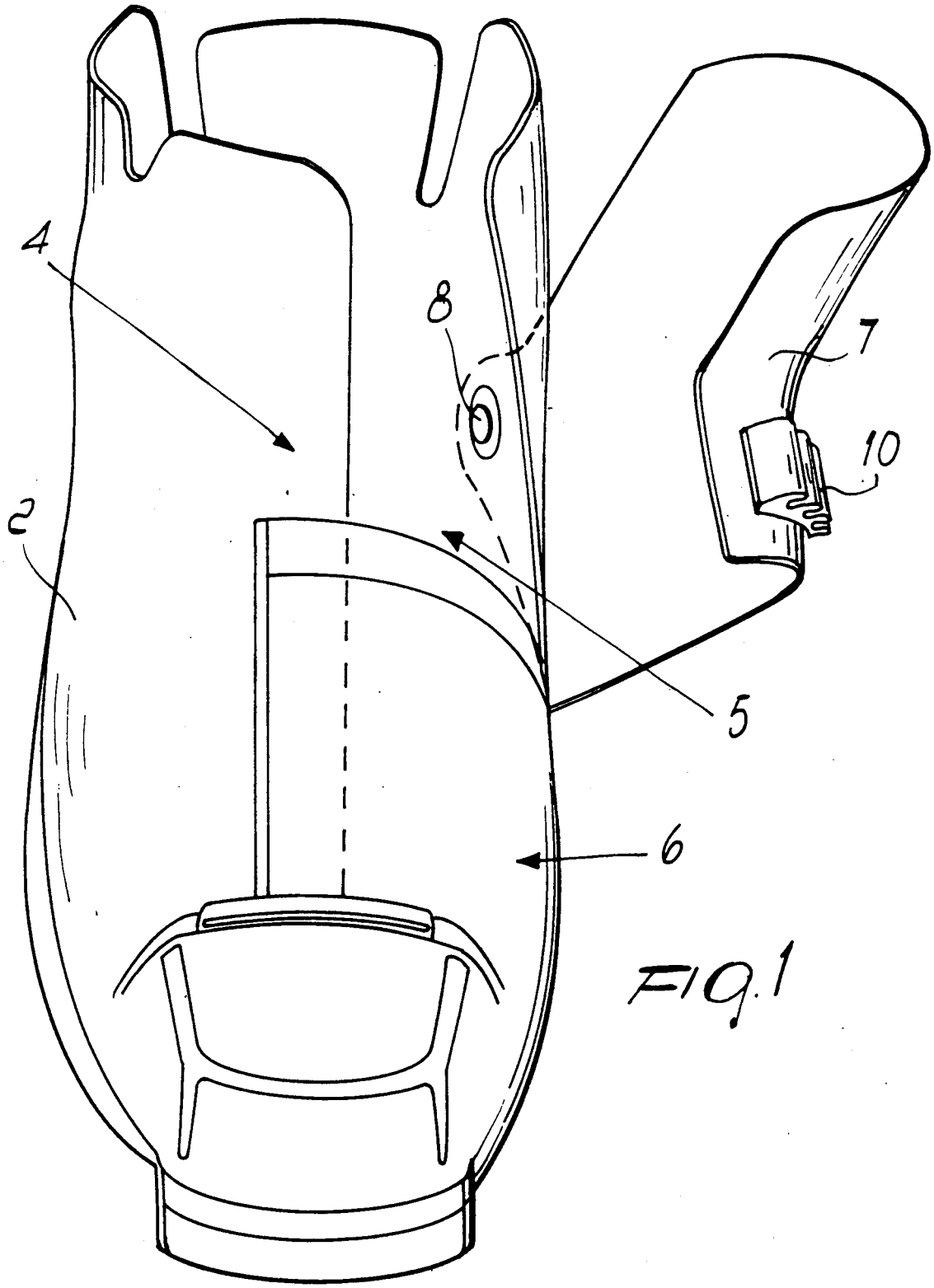
FIG. 1 is a partially open front view of the boot.
Figure 3:
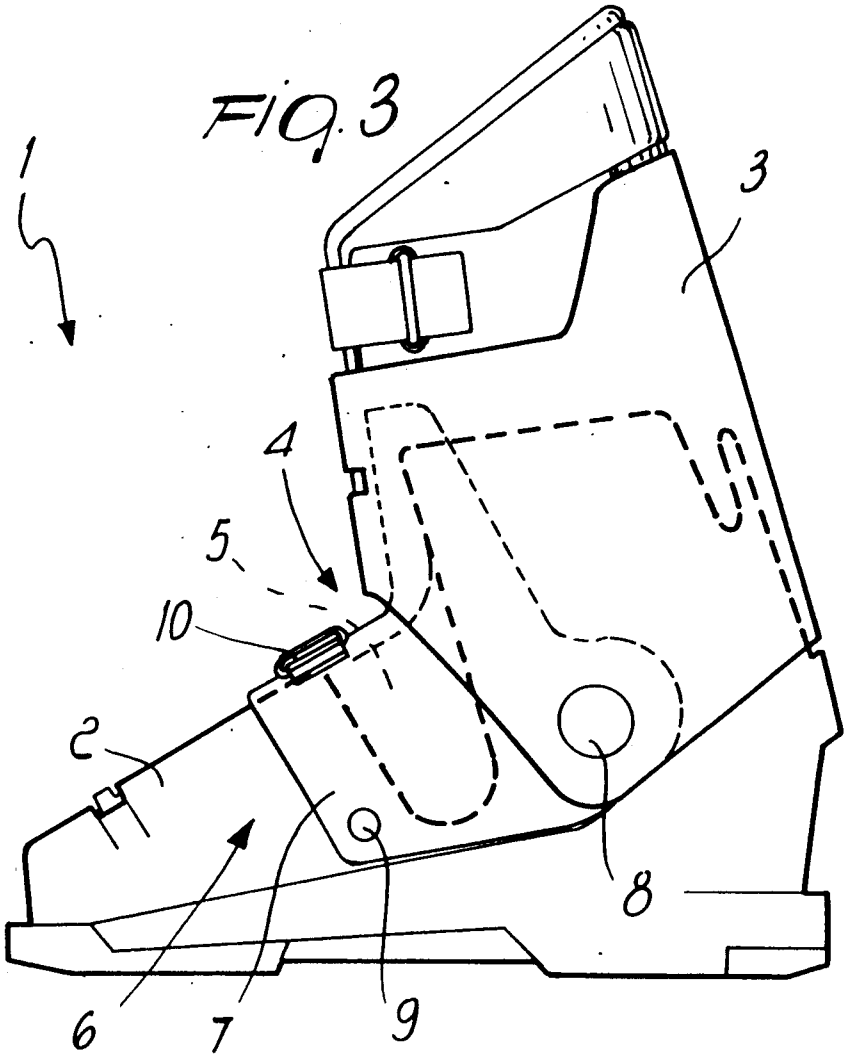
FIGS. 2 and 3 are opposite side views of said boot.
Figure 2:
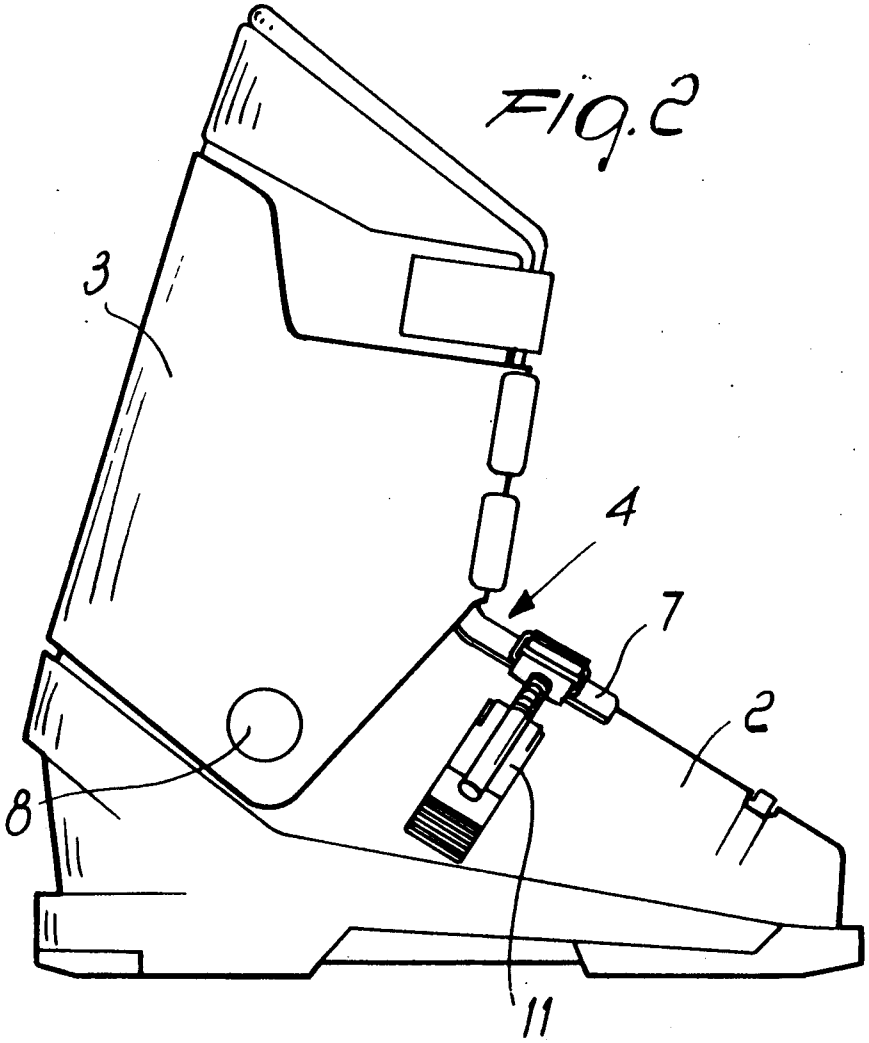

With reference to the above described figures, the reference numeral 1 indicates a boot, of the front-entry type, constituted by a shell 2 to which a quarter 3 is articulated.

At the metatarsal region 4 of the foot, said shell 2 has a slot 5 which is arranged transversely to the longitudinal axis of the shell 2 and affects only the inner lateral region 6 of said shell 2.

Said slot is thus provided at the side of the boot which is adjacent to the inner malleolus of the skier's foot.

A band-like element 7 is furthermore applied to said shell 2 or is an integral part thereof.

In the illustrated embodiment, said band-like element 7 is associated with the side of said shell 2 bearing the slot 5 at a first stud 8 for the pivoting of the quarter 3 and at a second stud 9 arranged on the opposite side to the first stud 8 with respect to the longitudinal axis of the slot 5.

Said band-like element 7 completely conceals the slot 5, and one or more fastening means are associated with its end which is not coupled to the shell 2; said means are constituted, for example, by a rack 10 which interacts with an adapted lever 11 associated with the shell 2 on the opposite side with respect to said second stud.

The use of the shell structure is therefore as follows: if the skier does not associate the lever 11 with the rack 10, once he has opened the quarter 3, the skier may further open the foot's access to the boot by raising the band-like element 7.

With said first operation the skier's foot can in fact find, besides a greater ductility of the shell, the presence of the slot 5 which aids its insertion.

Once the foot is inserted, and once the band-like element 7 is therefore superimposed on the slot 5, the optimum fastening of the foot region which extends from the plantar arch to the metatarsal region is achieved by locking the lever 11, since the band-like element 7 makes the shell adhere to the shape of the foot.

A single vertical securing action is in fact not exerted; said action instead has a lateral component which secures the foot, in particular in the inner lateral region, starting from its plantar arch.

The fact is furthermore stressed that since the band-like element 7 partially encircles the foot inside the shell, said shell adheres perfectly to the foot's metatarsal region not only at the upper portion but also at the lateral ones.

The shell is thus moved into contact with the foot, eliminating any empty spaces therebetween and thus ensuring the perfect transmission of the efforts from the foot to the ski.

Finally, an advantage which can be obtained in manufacturing the ski boot is stressed: the presence of the lateral slot 5 allows the optimum extraction of the shell from the mold.

The shell structure has been described for a ski boot of the front entry type but it is intended that the structure according to the invention is adapted also for ski boots of the rear entry type having a shell with overlapping flaps or front and rear separate quarters.

It has thus been observed that the invention achieves the intended aim and objects, a shell structure having been provided which besides allowing the easy insertion of the foot inside said shell also allows the optimum securing thereof.

The particular arrangement of the slot and of the band-like element which embraces said slot therefore allow the optimum adherence of the shell to both the upper and lateral portions of the foot's metatarsal region.

The invention is naturally susceptible to numerous modifications and variations, all of which are within the scope of the same inventive concept.

The materials and dimensions of the individual components, such as for example the depth and the width of the slot 5, may naturally also be the most appropriate according to the specific requirements.

I claim:

1. Shell structure for ski boots comprising;

a ski boot shell having internal surface, a longitudinal axis defined by said shell, a first side defined laterally on said shell, an opposite side defined laterally on said shell opposite to said first side, a metatarsal region defined on said first side of said shell, at least one slot extending transversely to said longitudinal axis of said shell and affecting said metatarsal region, at least one cover element connected to said shell and being positionable over said slot, at least one portion defined by said cover element, and tightening means connected to said shell and being releasably connectable to said portion of said cover element for tightening said cover element onto an inner malleolus region of a wearers foot adjacent said slot, wherein said cover element comprises at least one band-like element, wherein said shell has a lateral surface and, wherein said band-like element has at least one end and at least one other end, said lateral surface being defined at said first side of said shell, said one end of said band-like element being integral with said lateral surface of said shell, said tightening means releasably connecting said other end of said band-like element to said opposite side of said shell, whereby a wearers foot is pressed against said internal surface of said shell and said band-like element causes said shell to adhere to the shape of the wearers foot, at the upper and lateral metatarsal regions thereof.

2. Shell structure for ski boots comprising;

a ski boot shell having an internal surface, a longitudinal axis defined by said shell, a first side defined laterally on said shell, an opposite side defined laterally on said shell opposite to said first side, a metatarsal region defined on said first side of said shell, at least one slot extending transversely to said longitudinal axis of said shell and affecting said metatarsal region, at least one cover element connected to said shell and being positionable over said slot, at least one portion defined by said cover elements and tightening means connected to said shell and being releasably connectable to said portion of said cover element for tightening said cover element onto an inner malleolus region of a wearers foot adjacent said slot, wherein said cover element comprises at least one band-like element, and wherein said band-like element has at least one end and at least one other end, said one end of said band-like element being connected to said first side of said shell, said tightening means releasably connecting said other end of said band-like element to said opposite side of said shell, whereby a wearers foot is pressed against said internal surface of said shell and said cover element causes said shell to adhere to the shape of the wearers foot, at the upper and lateral metatarsal regions thereof.

3. Shell structure for ski boots comprising;

a ski boot shell having an internal surface, a longitudinal axis defined by said shell, a first side defined laterally on said shell, an opposite side defined laterally on said shell opposite to said first side, a metatarsal region defined on said first side of said shell, at least one slot extending transversely to said longitudinal axis of said shell and affecting said metatarsal region, at least one cover element connected to said shell and being positionable over said slot, at least one portion defined by said cover element, and tightening means connected to said shell and being releasably connectable to said portion of said cover element for tightening said cover element onto an inner malleolus region of a wearers foot adjacent said slot, wherein said cover element comprises at least one band-like element, and wherein said band-like element is an integral part of said shell, whereby a wearers foot is pressed against said internal surface of said shell and said cover element causes said shell to adhere to the shape of the wearers foot, at the upper and lateral metatarsal regions thereof.

* * * * *